United States Patent [19]

Tenconi

[11] Patent Number: 5,072,603

[45] Date of Patent: Dec. 17, 1991

[54] KNITTING MACHINE WITH NEEDLE CONTROL DEVICE FOR THE KNITTING OF PATTERN STITCHES

[75] Inventor: Riccardo Tenconi, Varese, Italy

[73] Assignee: Mec-Mor S.r.l., Induno Olona, Italy

[21] Appl. No.: 548,338

[22] Filed: Jul. 5, 1990

[30] Foreign Application Priority Data

Jul. 10, 1989 [IT] Italy ..... 21141 A/89

[51] Int. Cl.[5] ..... D04B 15/66

[52] U.S. Cl. ..... 66/222; 66/75.1

[58] Field of Search ..... 66/75.1, 222, 225, 42 A

[56] References Cited

U.S. PATENT DOCUMENTS

| | | | |
|---|---|---|---|
| 2,987,899 | 6/1961 | Mahler | 66/42 A X |
| 3,690,125 | 9/1972 | Tenconi | 66/222 X |
| 4,662,192 | 5/1987 | Schimko | 66/75.1 |
| 4,819,455 | 4/1989 | Schimko | 66/75.1 |

FOREIGN PATENT DOCUMENTS

| | | | |
|---|---|---|---|
| 2138743 | 2/1973 | Fed. Rep. of Germany | 66/75.1 |
| 835365 | 9/1938 | France | 66/75.1 |
| 404601 | 4/1932 | United Kingdom | 66/75.1 |

*Primary Examiner*—Werner H. Schroeder
*Assistant Examiner*—John J. Calvert
*Attorney, Agent, or Firm*—Guido Modiano; Albert Josif

[57] ABSTRACT

The machine has a needle holder element which has a plurality of grooves. Each groove accommodates at least one needle and one selector which faces, with one of its longitudinal ends, the base of the needle. Each needle has at least one heel which protrudes from the related groove of the needle holder element and is engageable in paths defined by cams which face the needle holder element, in order to actuate the needles with a reciprocating longitudinal motion along the grooves for forming knitting. Each needle is oscillable in a plane which is substantially parallel to the sides of the related groove for the passage of its heel from a position in which it is sunk in the groove to an extracted position in which it protrudes from the related groove. An extraction element is provided in each of the grooves between the selector and the related needle and is controllably movable from an inoperative position, in which it does not interfere with the position of the needle, to an operative position, in which it defines a rest for the side of the needle which is opposite to its heel so as to keep the heel in an extracted position.

6 Claims, 3 Drawing Sheets

KNITTING MACHINE WITH NEEDLE CONTROL DEVICE FOR THE KNITTING OF PATTERN STITCHES

BACKGROUND OF THE INVENTION

The present invention relates to a knitting machine with needle control device for the knitting of pattern stitches.

As known, in order to produce patterns on knitted fabrics with knitting machines, the needles of the machine which are intended to operate in the region of the patterns are selected and actuated so as to produce held stitches or so as not to form knitting at one or more feeds or drops of the machine alternately to the stitches with which the bottom and possibly internal regions of the pattern are produced.

For example, in circular knitting machines, which comprise a needle holder element constituted by a cylinder on the lateral surface whereof a plurality of grooves is defined, said grooves being parallel to its axis, each groove slidably accommodating a needle and, below said needle, a selector, each needle and each selector having at least one heel which protrudes radially from the needle cylinder to engage in paths defined by the skirt of the cams which embrace the needle cylinder, upstream of each machine feed according to the rotary motion imparted to the cam skirt with respect to the needle cylinder, there are selection devices constituted by levers which can be controllably actuated so as to interfere or not interfere with the heels of the selectors so as to move the overlying needles to engage, with their heel, within paths which are an alternative to other paths, thus selecting the needles which must take the thread supplied to said feed.

One or more cams are provided between the selection device and the machine feed, in the cam skirt, and define a path for the heel of the needles or for the heel of sub-needles interposed between the selectors and the needles, with a first rising portion and, subsequent thereto, a second rising portion which move the needle so as to protrude with its point upward from the needle cylinder by such an amount as to engage the thread supplied by the feed.

More particularly, the engagement of the needle or sub-needle with the first rising portion causes the needle to rise to a level which is sufficient to engage the thread, whereas the loop formed previously by said needle slides along the point of the needle, opening the tab thereof without disengaging therefrom. The engagement of the needle or sub-needle with the second rising portion causes a further lifting of the needle to such a level that the previously formed loop disengages from the tab of the needle and descends along the needle stem. A lowering cam is provided downstream of the feed in the cam skirt and engages the heel of the needle so as to lower it, moving its point, with the thread engaged thereto, inside the previously formed loop, thus forming a new loop and disengaging the needle from the previous loop.

In order to knit normal knitting stitches, the heel of the needles or sub-needles engages the lifting cam both along the first rising portion and along the second rising portion and engages the descending portion of the lowering cam.

In order to knit a held stitch, the heel of the needle or sub-needle is prevented from engaging the second rising portion of the lifting cam.

Finally, in order to prevent the forming of knitting, the heel of the needle or sub-needle is prevented from engaging the lifting cam.

In order to prevent the heel of the needle or sub-needle from engaging the lifting cam or its second rising portion, i.e. in order to exclude a needle from knitting or to produce a held stitch, in some kinds of machine the sub-needles are provided elastically flexible, so that by acting on their heel it is possible to sink said heel into the related groove of the needle cylinder. In this manner the heel passes on the side of the lifting cam which is directed toward the needle cylinder and does not engage the rising portion upstream of which it has been sunk.

At the end of the lifting cam, the elasticity of the sub-needle causes the extraction of the heel, which can engage other cams of the cam skirt. To provide exclusion from knitting, the heel of the sub-needle is sunk upstream of the lifting cam by means of a control cam, whereas in order to produce a held stitch the sinking is performed, again by means of an adapted control cam, between the first rising portion and the second rising portion of the lifting cam.

Some problems are observed in machines which use flexible sub-needles to provide these types of knitting.

Since the needle is lowered with the lowering cam acting directly on the needle, the heel of all the needles, even those which are excluded from knitting at the feed being considered or which have produced a held stitch, engages in fact against said cam, with the disadvantage of a deformation of the loop engaged by the point of the needle if said loop is smaller than those formed at the feed being considered.

The assembly constituted by needle, sub-needle and selector furthermore has a considerable length which entails a corresponding height of the needle cylinder. Even greater problems occur in the needle plate in circular machines with two needle holders, since problems of bulk arise especially in small-diameter machines for the execution of the grooves in the direction of the plate axis since the grooves which accommodate said assembly are arranged radially.

Other kinds of machine use needles which can oscillate in a plane which is parallel to the sides of the groove in which they are accommodated, so as to move their heel from a sunk position to an extracted position or vice versa, by providing, between the side of the needle which is opposite to the heel and the bottom of the groove, a spring which keeps the needle with its heel in an extracted position but allows, by yielding elastically, to push, by means of appropriate cams, the heel into a sunk position to prevent its engagement for example with the lifting cam in order to exclude the needle from knitting at one feed, or with the second rising portion of said lifting cam in order to produce a held stitch.

The possibility of sinking the heel of the needles can avoid the engagement of the needles with the lowering cam for those needles which are excluded from knitting at the feed being considered and therefore also solves the problem of the deformation of the loop previously engaged by the needle.

Nonetheless, during the descent of the needle, the engaged thread, particularly in the case of scarcely elastic threads, exerts an action which can cause the unwanted sinking of the heel of the needle, with consequent disengagement from the lowering cam and therefore with faults in knitting and with the possibility of damage or breakage of the needle.

SUMMARY OF THE INVENTION

The aim of the present invention is to solve the above described problems by providing a knitting machine which avoids the accidental sinking of the heel of the needles though it uses needles which can oscillate inside the related groove of the needle holder element.

Within the scope of this aim, an object of the invention is to provide a machine which avoids the unwanted deformation of the loops carried by needles which do not knit at a machine feed.

Another object of the invention is to provide a machine which can be manufactured with modifications which are simple to effect and have a modest cost starting from a conventional machine.

This aim, these objects and others which will become apparent hereinafter are achieved by a knitting machine, with needle control device for the knitting of pattern stitches, which comprises a needle holder element which has a plurality of grooves, each of which slidably accommodates at least one needle and a selector which is arranged facing, with one of its longitudinal ends, the base of said needle, each needle having at least one heel which protrudes from the related groove of the needle holder element and can engage paths defined by cams which face said needle holder element for the actuation of the needles with a reciprocating longitudinal movement along said grooves to form knitting, each of said needles being oscillable in a plane which is substantially parallel to the sides of the related groove for the passage of its heel from a position in which it is sunk in said groove to an extracted position in which it protrudes from said groove, characterized in that it comprises an extraction element which is arranged in each of said grooves between the selector and the related needle and is controllably movable from an inoperative position, in which it does not interfere with the position of said needle, to an operative position, in which it defines a rest for the side of said needle which is opposite to its heel in order to keep said heel in the extracted position.

BRIEF DESCRIPTION OF THE DRAWINGS

Further characteristics and advantages of the invention will become apparent from the description of a preferred but not exclusive embodiment of the machine according to the invention, illustrated only by way of non-limitative example in the accompanying drawings, with reference to a circular machine with a single holder in which the needle holder element is constituted by the needle cylinder, wherein.

DESCRIPTION OF THE PREFERRED EMBODIMENTS

Figure 4:
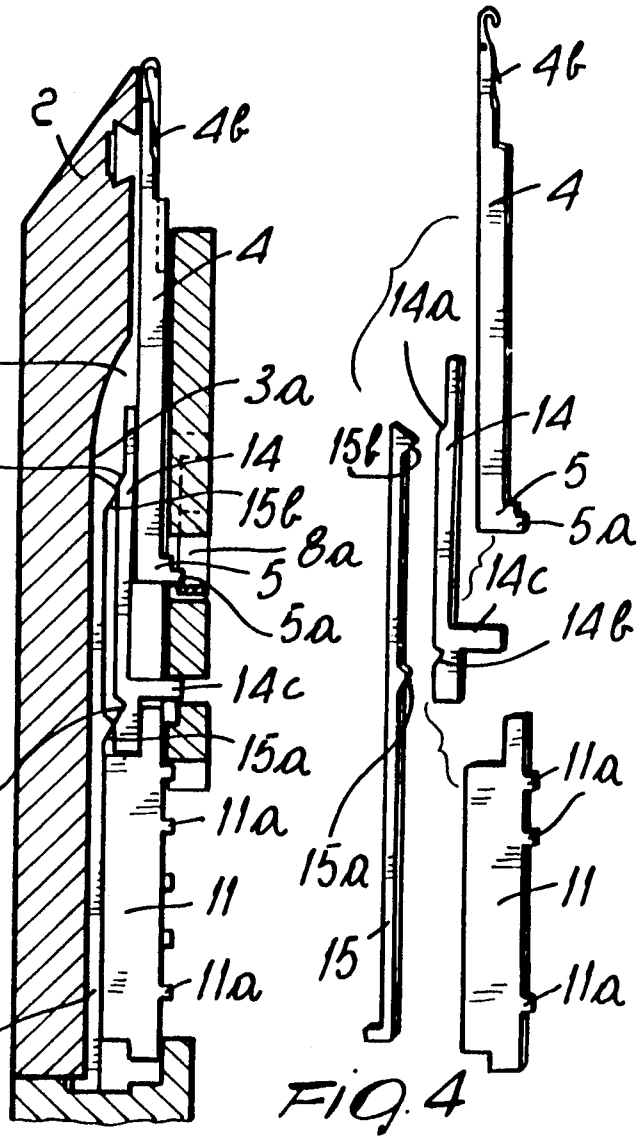
FIG. 4 is an exploded perspective view of the various elements contained in a same groove of the needle cylinder.

With reference to the above figures, the machine according to the invention, generally indicated by the reference numeral 1, comprises a needle holder element 2, constituted by the needle cylinder in the illustrated case, which has a plurality of grooves 3 defined on its lateral surface in an axial direction. A needle 4 is slidably accommodated inside each groove 3, and has a heel 5 proximate to its base end and is oscillable in a plane which is parallel to the sides of the related groove in order to move its heel 5 from a sunk position, in which it is arranged inside the groove 3, to an extracted position, in which the heel 5 protrudes from the groove 3 so as to engage the paths defined in the cam skirt 6 which is arranged around the needle cylinder and is moved relatively thereto about the axis of the needle cylinder.

Figure 1:
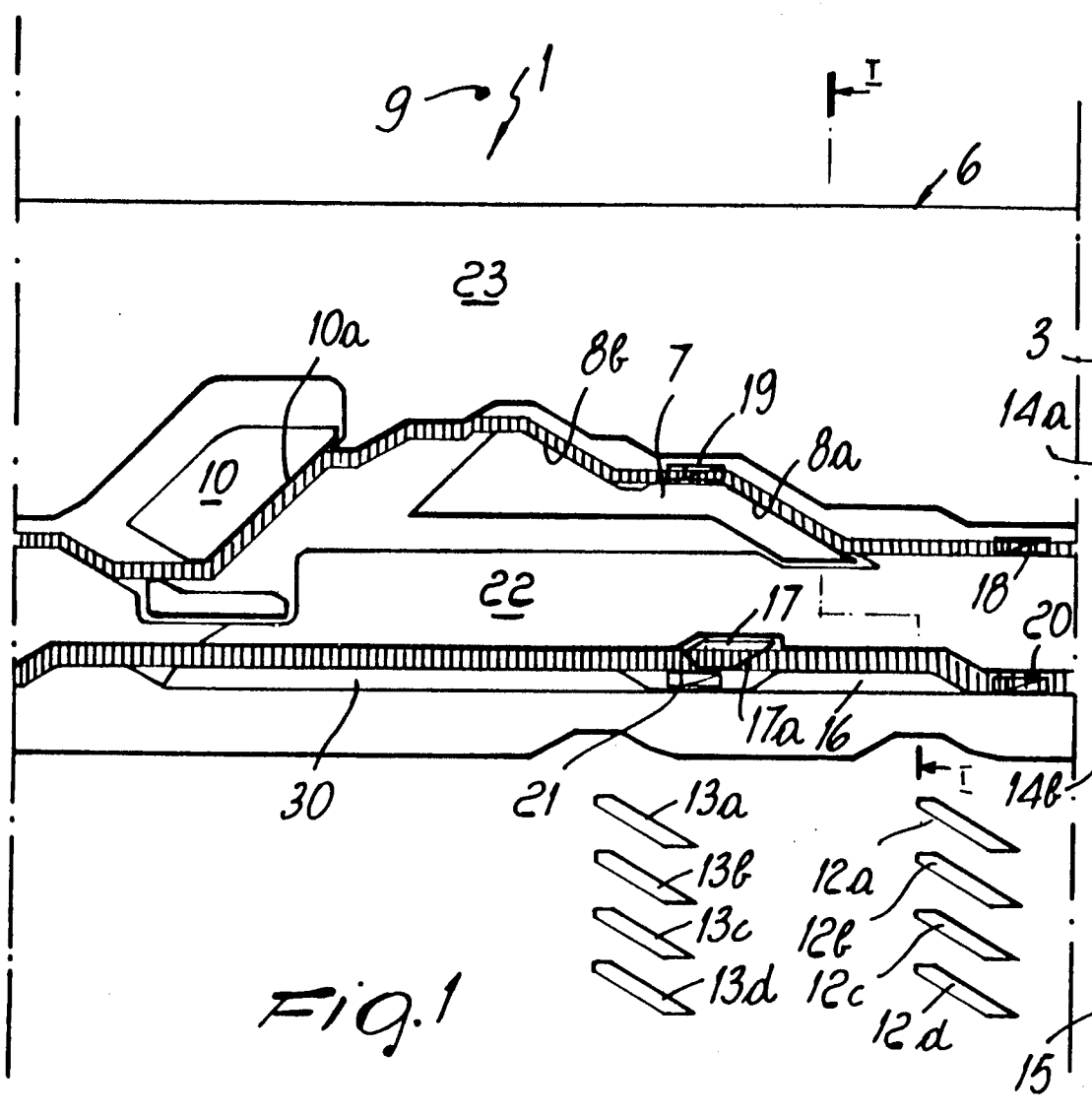
FIG. 1 is a schematic view from the side directed toward the needle cylinder of the cam skirt of a circular knitting machine, developed on a plane, indicating the paths of the heel of a needle and of the heels of the elements arranged in the same groove when the needle is to perform a normal knitting stitch at the feed being considered, and with a cross section of the needle cylinder and of the cam skirt, taken along the line I—I of the same figure, arranged next to it.
Figure 2:
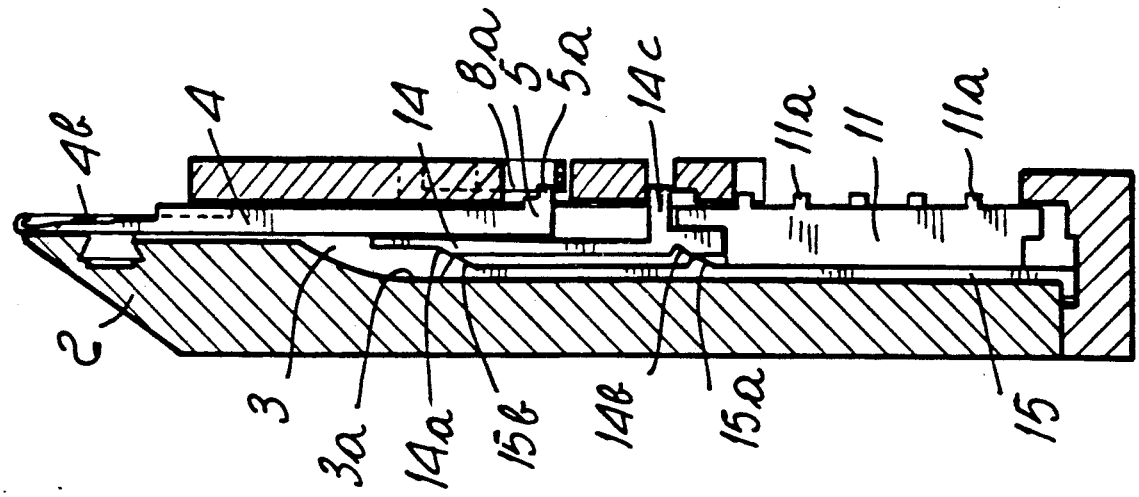
FIG. 2 is a view similar to FIG. 1, with reference to the execution of a held stitch and with a cross section view of the needle cylinder and of the cam skirt taken along the axis II—II of said FIG. 2.
Figure 2:
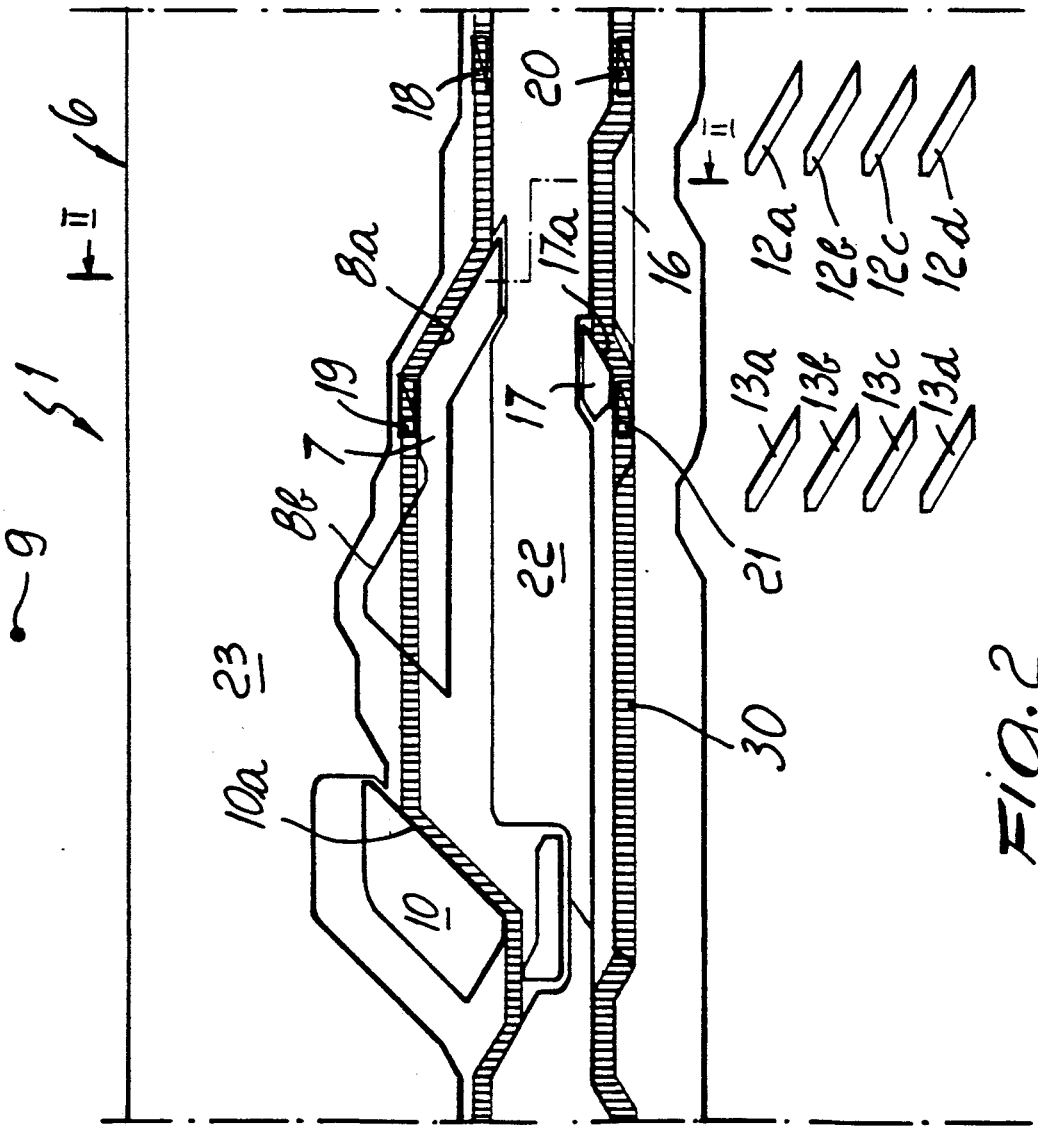
Figure 3:
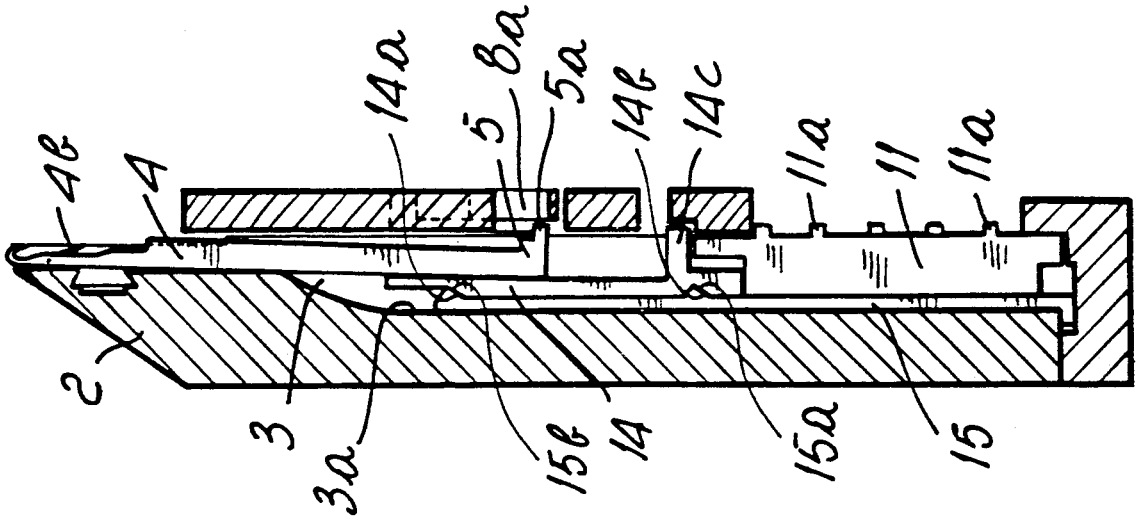
FIG. 3 is a view similar to the preceding figures, with reference to the exclusion of a needle from the knitting at the feed being considered and with a sectional view of the needle cylinder and of the cam skirt, taken along the axis III—III, arranged next to it.
Figure 3:
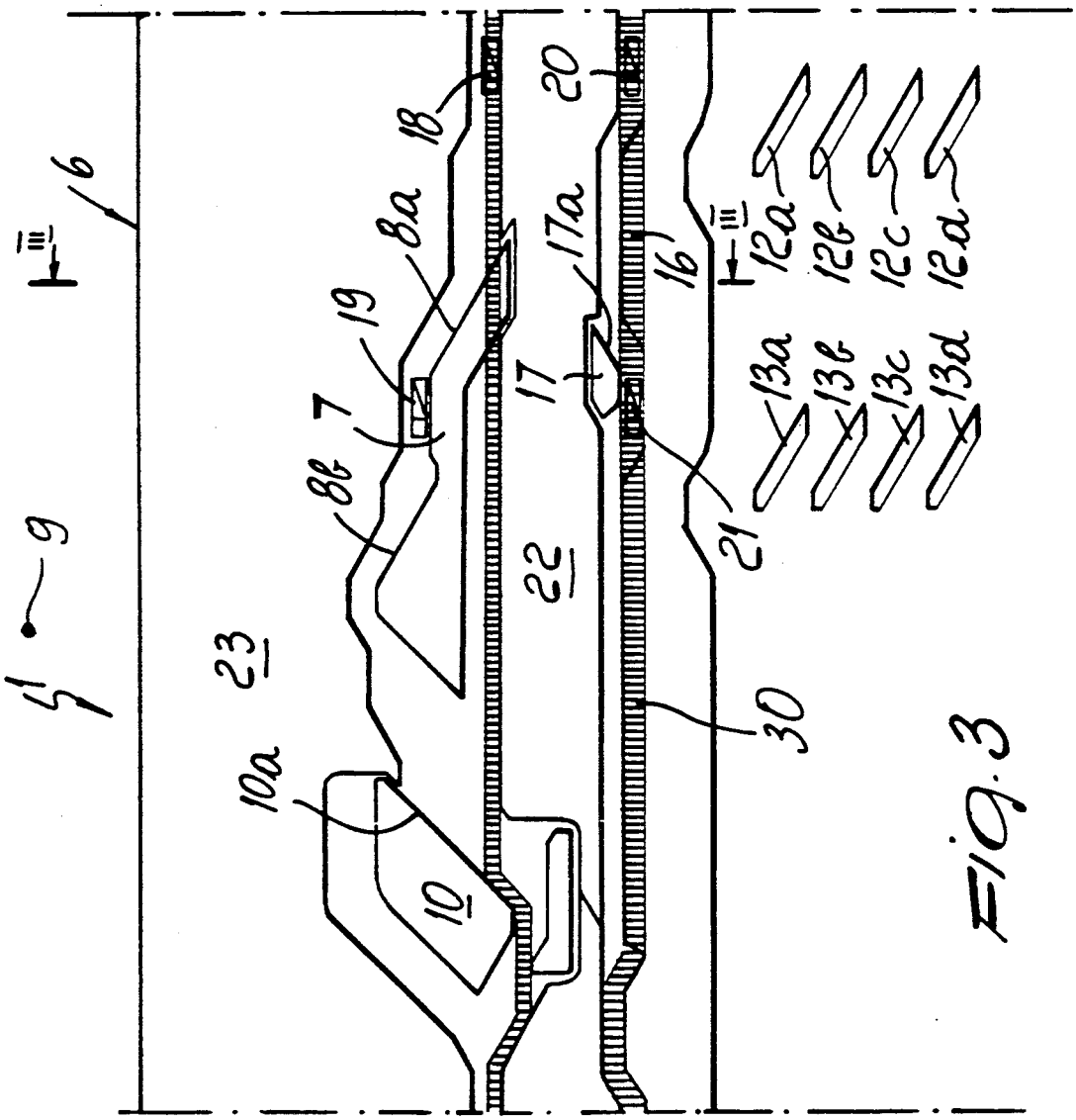

The cam skirt 6, of which only a portion is illustrated in FIGS. 1 to 3, comprises in particular a lifting cam 7 which has a first rising portion 8*a* and a second rising portion 8*b* arranged in sequence according to the motion of the cam skirt with respect to the needle cylinder. A machine feed or drop, schematically indicated by the point 9 in FIGS. 1 to 3, i.e. the region in which the thread guides which supply the thread to the needles 4, is arranged downstream of the first rising portion 8*a* above the needle cylinder.

A lowering cam 10 is provided downstream of the lifting cam 7, again according to the motion of the cams with respect to the needle cylinder, and defines a descending portion 10*a* for the needles 4.

A selector 11 is accommodated in each groove 3, below the needles 4, and has one or more heels 11*a*, according to the requirements, which protrude from the groove 3 to undergro the selection of known devices which are arranged facing the needle cylinder and are schematically indicated in the figures by levers 12*a*, 12*b*, 12*c*, 12*d* and 13*a*, 13*b*, 13*c*, 13*d* which can be moved toward the needle cylinder in order to interfere with the heels. In the illustrated embodiment, said levers having rising portions which can engage the heels 11*a* so as to lift the selectors.

Two sets of selection devices are conveniently provided and are rigidly associated with the cam skirt 6 in their motion with respect to the needle cylinder; a first set, constituted by the levers 12*a*, 12*b*, 12*c*, 12*d*, is arranged upstream of the first rising portion 8*a*, whereas the second set, constituted by the levers 13*a*, 13*b*, 13*c*, 13*d*, is arranged between the first rising portion 8*a* and the second rising portion 8*b*, as will become apparent hereinafter.

According to the invention, an extraction element 14 is arranged in each groove 3, is located between the selector 11 and the needle 4 and is controllably movable from an inoperative position, in which it does not interfere with the position of the needle 4, to an operative position, in which it defines a rest for the needle 4 on the side thereof which is opposite to the heel 5 so as to prevent the accidental sinking of the needle heel when it is in extracted position.

More particularly, said extraction element 14 is conveniently constituted by a shaped plate arranged between the side of the needle which is opposite to the heel 5 and the bottom 3*a* of the groove. At least one portion, two portions 14*a* and 14*b* in the illustrated case, of the extraction element which are directed toward the bottom of the groove 3 are in the shape of an inclined plane and can be coupled, by means of the lifting of the extraction element 14 along the groove 3, i.e. along a direction which is parallel to the longitudinal extension of the needle 4, with portions 15*a* and 15*b* which are correspondingly provided on the bottom of the groove so that the lifting of the extraction element 14 causes a movement of said extraction element toward the outside of the needle cylinder, causing the passage of the needle, with its heel 5, from the sunk position to the extracted position.

Advantageously, the inclined portions 15*a* and 15*b* are defined on a rod 15 which is blocked to the bottom of the groove 3.

The lower end of the extraction element 14 is arranged facing the upper end of the selector 11 so that a longitudinal movement of the selector 11 toward the needle pushes the extraction element from the inoperative position to the oeprative position.

The plate 14 is conveniently provided, on its opposite side with respect ot the bottom of the groove, with a heel 14*c* which protrudes further from the needle cylinder when thy extraction element is in the operative position and engages a path defined in the cam skirt. Two lifting cams 16, 30 are provided along said path and engage the heel 14*c* only if the extraction element 14 is in the operative position. An actuation cam 17 is furthermore provided along said path, is controllably movable toward or away from the needle cylinder, in a known manner, depending on the knitting requirements, and has a descending portion 17*a* to cause, if activated, the movement of the extraction element toward the selector.

Sinking cams 18 and 19 are conveniently provided along the path defined by the cams which act on the needle heel and are controllably activatable and deactivatable in a known manner by means of their movement towards or away from the needle cylinder; if they are activated, they act on the heel of the needle to cause its movement from the extracted position to the sunk position. Said sinking cams 18 and 19 are arranged respectively upstream of the first rising portion 8*a* of the cam 7 and between the first rising portion 8*a* and the second rising portion 8*b*. In particular, the sinking cam 19 is arranged downstream of the actuation cam 17 between the cams 16 and 30.

Though the sinking of the needle heel performed by the cams 18 and 19, which is possible only with the extraction element 14 in its inoperative position, also achieves the sinking of the heel 14*c* of said extraction element, two safety cams 20 and 21, similar to the cams 18 and 19 are provided at the cams 18 and 19 along the path of the heel 14*c*; when said safety cams are activated, they act on the heel 14*c* toward the bottom of the groove so as to sink said heel if required.

The heel 5 of the needles 4 advantageously has a tab 5*a* which protrudes from the groove even when the needle heel is in sunk position.

Said tab 5*a* has smaller dimensions, in the longitudinal direction of the needle, than the remaining part of the heel and is located proximate to the lower end of the heel 5.

The lifting cam 7 is furthermore spaced from the needle cylinder by an amount comprised between the dimensions of the tab 5*a* which protrudes from the needle cylinder when the heel 5 is in a sunk position and the dimensions of the heel 5, including the tab 5*a*, when the heel 5 is in extracted position, so that when the heel 5 is in a sunk position the engagement of the heel 5 on the part of the lifting cam 7 is prevented.

The lowering cam 10 is closer to the needle cylinder than the lifting cam 7 so as to engage the heel 5 when said heel is in an extracted position and only the tab 5*a* when the heel 5 is in sunk position.

For the sake of completeness in description it should be noted that fixed countercams 22, 23 are provided in the cam skirt and co-operate with the described cams so as to define the various paths for the heel of the needles and for the extraction element.

The operation of the machine according to the invention is as follows.

With reference to FIG. 1, if it is necessary to perform a normal knitting stitch, one of the heels 11*a* of the selector 11 is engaged by means of one of the levers 12*a*, 12*b*, 12*c*, 12*d* of the selection device so as to cause the lifting of the chosen selector or selectors toward the needle 4. The lifting of the selector 11 causes the passage of the extraction element 14 from the inoperative position to the operative position, with consequent extraction of the heels 14*c* and 5. In this manner the heel 5 engages along the first rising portion 8*a* and along the second rising portion 8*b* of the cam 7, moving the needle 4 to take-up the thread and unloading the previously formed loop along its stem, below the tab 4*b*. In this case the sinking cams 19 and 21 are not activated and the heel 5 of the needle engages the descending portion 10*a* of the lowering cam 10, causing the formation of a new loop and the casting-off of the previous loop.

It should be noted that accidental sinking of the heel during formation of the stitch is safely prevented, since said heel is kept in extracted position by the presence of the extraction element 14, which is activated and kept in said position by the cams 16 and 30.

With reference to FIG. 2, in order to produce a held stitch, one proceeds initially as in the case of a stitch of normal knitting, i.e. a selector 11 is lifted by means of one of the levers 12*a*, 12*b*, 12*d*, with the consequent extraction of the needle heel 5. Contrary to what has been described above, the actuation cam 17 and the cams 19 and 21 are activated. In this manner, after following the first rising portion 8*a*, the heel 5 is moved to a sunk position and does not engage the second rising portion 8*b*. Due to this fact, the point of the needle 4 engages the thread supplied by the feed, but the previously formed loop is not unloaded onto the stem of the needle but rests on the tab, producing a held stitch. The needle is subsequently lowered again since the tab 5*a* engages the lowering cam 10.

It should be noted that since only the tab 5*a*, which is lower than the remaining portion of the heel, engages against the lowering cam 10, the formed loop undergoes less tensioning than that which would be caused by the engagement of the entire heel with said lowering cam. In this manner unwanted deformations of the loop in the held stitch are avoided.

With reference to FIG. 3, if a needle is to be excluded from knitting at the feed being considered, the cams 18 and 20 are activated, and none of the levers of the selection devices engage the heel 11*a* of the selector 11. The position of the cams 19, 21 and 17 is irrelevant, since both the heel 5 of the needle and the heel 14*c* of the extraction element are in a sunk position.

In this case, too, the tab 5*a* of the heel of the needle engages the lowering cam but causes no deformations of the loop possibly present on the point of the needle.

In practice it has been observed that the machine according to the invention fully achieves the intended aim, since by virtue of the extraction element it safely prevents the accidental sinking of the heel of the needle, avoiding faults in knitting.

Furthermore, by virtue of the particular step-like configuration of the needle heel, deformations of the loops are avoided both when the needle produces a held stitch and when it does not knit at a feed.

Though the machine according to the invention has been described with particular reference to the needle cylinder of a circular machine with a single needle bed or holder, the characteristics which are the subject of the invention can be applied to a machine with two needle beds or holders, i.e. the needle holder element can be constituted by both the needle cylinder and the needle plate, or to a rectilinear machine, without however abandoning the scope of the protection of the present invention.

The machine thus conceived is susceptible to numerous modifications and variations, all of which are within the scope of the inventive concept; all the details may furthermore be replaced with technically equivalent elements.

In practice, the materials employed, as well as the dimensions, may be any according to the requirements and to the state of the art.

I claim:

1. Knitting machine, with needle control device for knitting pattern stitches, comprising a needle holder element having a plurality of grooves each of which slidably accommodates at least one needle and a selector arranged facing, with one longitudinal end, the base of said needle, each said at least one needle being provided with at least one heel protruding from the related groove of the needle holder element and being engageable in paths defined by cams arranged facing said needle holder element for the actuation of said needles with a reciprocating longitudinal movement along said grooves for forming knitting, each of said needles being oscillable in a plane substantially parallel to the sides of the related groove for the passage of a heel of the needle from a position where the needle is sunk in said groove to an extracted position where the needle protrudes from said groove, comprising an extraction element arranged in each of said grooves between the selector and the related needle and being controllably movable from an inoperative position, said extracting element does not interfere with the position of said needle, to an operative position, the extraction element defines a rest for the side of said needle opposite with respect to the heel of the needle to keep said heel in the extraction position, wherein said extraction element is substantially constituted by a shaped plate arranged between the side of the needle opposite to the heel and the bottom of the groove, said plate having at least one portion having the shape of an inclined plane and is associable with at least one correspondingly shaped portion provided on the bottom of said groove, said plate being controllably movable from said inoperative position to said operative position along a direction substantially parallel to the longitudinal extension of the needle for the movement of said plate away from the bottom of said groove upon the coupling of said inclined portions and, wherein said inclined portion provided on the bottom of said groove is defined on a rod blocked on the bottom of said groove.

2. Machine according to claim 1, wherein said plate has, on an opposite side with respect to the bottom of the groove, a heel protruding from said groove and is engageable in a path defined in the cam skirt facing said needle holder element, for the movement of said plate along a direction substantially parallel to the longitudinal extension of the needle.

3. Machine according to claim 1, wherein said plate has, on an opposite side with respect to the bottom of the groove, a heel protruding from said groove and is engageable in a path defined in the cam skirt facing said needle holder element, for the movement of said plate along a direction substantially parallel to the longitudinal extension of the needle, said machine further comprising along said path for the heel of said plate, a controllably activatable actuation cam with a descending portion engageable with the heel of said plate for a movement of said plate toward said selector.

4. Machine according to claim 1, wherein said plate has, on an opposite side with respect to the bottom of the groove, a heel protruding from said groove and is engageable in a path defined in the cam skirt facing said needle holder element, for the movement of said plate along a direction substantially parallel to the longitudinal extension of the needle, said machine further comprising along the path of the needle heel defined in the skirt of the cams arranged facing said needle holder element, sinking cams controllably activated for the passage of the heel of the needles from said extracted position to said sunk position when said shaped plate is in an inoperative position.

5. Machine according to claim 1, wherein the heel of each of said needles has a tab protruding from the related groove even when said heel is in sunk position, said tab having smaller dimensions, in the longitudinal direction of the needle, than the remaining part of the heel; a lowering cam being provided along the path of the needle heel defined in the cam skirt, said cam being engageable with said tab when said heel is in sunk position or engageable with said remaining part of the heel when said needle is in extracted position.

6. Machine according to claim 5, wherein a lifting cam is provided in the skirt of the cams which define paths for said needle heel, is arranged proximate to a machine feed and has a first rising portion and a second rising portion, said lifting cam being spaced, at least at said second rising portion, from said needle holder element by an amount comprised between the dimensions of said tab protruding from the groove, when said needle heel is in sunk position, and the dimensions of the needle heel including said tab, when said needle heel is in extracted position, a controllably activatable sinking cam being provided between said first rising portion and said second rising portion, and an actuation cam being provided upstream of said sinking cam according to the motion of the cam skirt relatively to the needle holder element, said actuation cam being controllably activatable so as to interfere or not interfere with the heel of the extraction element so as to cause the engagement of said needle heel with said second rising portion, when said sinking cam and said actuation cam are not activated, or to disengage the needle heel from said lifting cam, when said sinking cam and said actuation cam are activated.

* * * * *